US006228550B1

(12) United States Patent
Matsuda et al.

(10) Patent No.: US 6,228,550 B1
(45) Date of Patent: May 8, 2001

(54) TWO-COMPONENT DEVELOPER

(75) Inventors: Hiroaki Matsuda; Masanori Suzuki; Akemi Sugiyama; Hiroto Higuchi, all of Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/332,898

(22) Filed: Jun. 15, 1999

(30) Foreign Application Priority Data

Jun. 16, 1998 (JP) ..... 10-183281

(51) Int. Cl.[7] ..... G03G 9/113
(52) U.S. Cl. ..... 430/108
(58) Field of Search ..... 430/108, 109

(56) References Cited

U.S. PATENT DOCUMENTS 5,168,028 12/1992 Nanya et al. .
5,403,690 4/1995 Kuramoto et al. .
5,789,129 * 8/1998 Ochiai et al. ..... 430/106.6
6,004,715 * 8/1998 Suzuki et al. ..... 430/111

FOREIGN PATENT DOCUMENTS 62-66268 * 3/1987 (JP) .
3-12663 * 1/1991 (JP) .

OTHER PUBLICATIONS

Chemical Abstracts 115:60855, 1991.*
Chemical Abstracts 107:144877, 1987.*

* cited by examiner

*Primary Examiner*—Christopher Rodee
(74) *Attorney, Agent, or Firm*—Oblon, Spivak, McClelland, Maier & Neustadt, P.C.

(57) ABSTRACT

A two-component developer includes a toner containing toner particles with a volume diameter of 8 $\mu$m or less, and a carrier containing carrier particles, each carrier particle including at least one core particle and a carrier core coating layer, the carrier core coating layer being made of a silicone resin and a silicone oil, the carrier having a fluidity of 45 seconds or less.

2 Claims, No Drawings

TWO-COMPONENT DEVELOPER

BACKGROUND OF THE INVENTION

1. Field of the Invention

The present invention relates to a two-component developer for developing latent electrostatic images to toner images for use in electrophotography in a copying machine, facsimile apparatus or the like, and also for use in electrostatic recording, and electrostatic printing process.

2. Discussion of Background

Various electrophotographic methods are described, for instance, in U.S. Pat. No. 2,297,691, Japanese Patent Publication 42-23910, and Japanese Patent Publication 43-24748. In these methods, a photoconductive layer is irradiated with a light image corresponding to an original image to be copied, and a latent electrostatic image corresponding to the original image is formed on the photoconductive layer. In a normal development, a toner with an opposite polarity to that of the latent electrostatic image is deposited on the electrostatic image to develop the latent electrostatic image to a toner image on the photoconductive layer, and when necessary, the toner image is transferred to an image transfer material such as a sheet of paper, and the transferred toner image is then fixed thereto with the application of heat, pressure, heat and pressure, or a solvent vapor thereto, whereby a copied material can be obtained.

In the step of developing the latent electrostatic image to the toner image, the toner image is formed, utilizing the electrostatic attraction between charged toner particles and the latent electrostatic image. Generally, in the above-mentioned development method of developing the electrostatic image with the toner, a two-component developer comprising toner particles and carrier particles is preferably employed in a copying machine for which high image quality is demanded.

The carrier particles in the two-component developer are constantly stirred while in use for an extended period of time, so that the surface of the carrier particles is apt to be damaged and therefore it is difficult to attain stable triboelectric charging over an extended period of time.

Furthermore, a photoconductor drum, which is disposed so as to face a development sleeve for carrying the two-component developer thereon, is also abraded with the two-component developer, and a cleaning blade is brought into pressure contact with the photoconductor drum, so that the surface of the photoconductor drum is caused to deteriorate with time, and the image quality is also caused to deteriorate.

Japanese Laid-Open Patent Application 62-66268 discloses a carrier comprising carrier particles coated with a coating layer comprising a silicone-oil-containing silicone resin. In this prior art reference, it is stated that by the provision of the coating layer, the triboelectric charging characteristics of the carrier are improved, whereby images with such an image quality that is free of fogging can be obtained.

However, the silicone-oil containing carrier disclosed in the above-mentioned prior art reference, however, has the problems that the fluidity of the carrier is caused to deteriorate due to the presence of an excessive amount of the silicone oil in the surface layer of the carrier particles and therefore the toner cannot be appropriately charged by the carrier, so that the fogging is apt to take place.

Recently, in order to meet the demand for high quality image, an appropriate combination of the carrier and toner particles with a small particle diameter is essential. However, the above-mentioned prior art reference does not disclose anything about the combination of the carrier and a small-particle diameter toner, and conventionally, high quality images cannot be obtained when a small-particle diameter toner is employed.

In the above-mentioned prior art reference, there is disclosed a two-component developer composed of the carrier and toner particles with a particle diameter as small as 6.5 $\mu$m. The inventors of the present invention evaluated the developer. The result was that images obtained have such an image quality that has extreme fogging. The inventors of the present invention investigated the cause of the deterioration of the image quality with the extreme fogging and discovered that it is caused because the fluidity of the carrier is poor and the toner cannot be charged with an appropriate amount of triboelectric charges by the carrier. However, it is extremely difficult to provide a sharp charge quantity distribution by using small-particle diameter toners which are currently employed and the above-mentioned carrier because the triboelectric charging area in the small-particle diameter toners is large and the fluidity thereof is poor.

SUMMARY OF THE INVENTION

It is therefore an object of the present invention to provide a two-component developer free of the above-mentioned conventional problems, capable of providing high quality images with high precision and high reliability.

The object of the present invention can be achieved by a two-component developer comprising (a) a toner comprising toner particles with a volume diameter of 8 $\mu$m or less, and (b) a carrier comprising carrier particles, each carrier particle comprising at least one core particle and a carrier core coating layer, the carrier core coating layer comprising a silicone resin and a silicone oil, the carrier having a fluidity of 45 seconds or less.

In the above two-component developer, it is preferable that the carrier particles have a weight-average particle diameter of 60 $\mu$m or less.

DESCRIPTION OF THE PREFERRED EMBODIMENTS

The inventors of the present invention studied the improvement of the fluidity of the carrier to improve the image quality even when used in combination with a small-particle diameter toner.

More specifically, as mentioned above, the fluidity of the carrier can be improved by use of the carrier comprising carrier particles, each carrier particle comprising at least one core particle and a carrier core coating layer, the carrier core coating layer comprising a silicone resin and a silicone oil.

In other words, in the present invention, in order to impart excellent surface releasability to the carrier, the silicone oil is added to the carrier core coating layer, and the amount of the silicone oil in the surface layer of the carrier particles is controlled so as to exhibit excellent fluidity of the carrier, whereby the above-mentioned conventional problems have been decisively solved. To be more specific, a carrier comprising carrier particles coated with a carrier coating layer comprising a silicone oil in general use exhibits a stable charging performance for an extended period of time. Furthermore, a photoconductor drum is less abraded by the above-mentioned carrier, and the transfer performance of a toner tends to be improved when used in combination with the above-mentioned carrier. As a result, high quality images can be obtained in a stable manner.

Why the above can be attained when used the above-mentioned carrier has not yet been completely clarified, but it can be assumed that the above advantages are attained by the releasability and the lubricating properties of the silicone oil which oozes from the carrier core coating layer. In other words, it can be assumed that the silicone oil contained in the carrier core coating layer serves as a lubricant when the developer is stirred, and protects the carrier from the stress applied thereto when the developer is stirred, so that the charging performance of the developer can be maintained in a stable manner for an extended period of time.

The photoconductor drum is always in frictional contact with the developer, so that it is considered that an extremely small amount of the silicone oil is constantly applied to the surface of the photoconductor. As a result, a thin releasing layer made of the silicone oil is considered to be formed on the surface of the photoconductor drum. It is also considered that the photoconductor drum may be abraded mainly by (1) the developer which is in frictional contact with the photoconductor drum, and also by (2) the cleaning blade which is in pressure contact with photoconductor drum. However, the abrasion of the photoconductor drum is extremely reduced, when the silicone oil releasing layer is present on the surface of the photoconductor drum. Furthermore, the surface of the photoconductor drum can be protected from being scratched by the silicone oil releasing layer which serves as a protective layer even when some additives are externally applied thereto.

Furthermore, the silicone oil applied to the surface of the photoconductor drum is considered to have some effect on the toner transfer performance of the photoconductor drum. Conventionally, when toner is transferred from the surface of the photoconductor drum to an image transfer sheet, a small amount of the toner inevitably remains on the surface of the photoconductor drum, and the remaining toner reduces the image transfer ratio. However, in the present invention, since the silicone oil releasing layer is present on the surface of the photoconductor drum, the toner, substantially in its entirety, is transferred to the transfer sheet, so that an extremely high image transfer ratio can be secured. However, when an excess silicone oil is present on the surface of the photoconductor drum, the toner on the photoconductor drum is apt to be trapped by the silicone oil, so that the image transfer ratio is reduced on the contrary.

The fluidity of the carrier of the present invention can be controlled by adjusting the mixing ratio of the silicone oil and the silicone resin in a coating liquid for the formation of the carrier core coating layer, and controlling the heating conditions for heating the coated coating liquid coated on the core particles to form the carrier core coating layer.

It is preferable that the amount of the silicone oil be in the range of 2 to 10 wt. % of the entire weight of the coated coating liquid. Although it depends upon the curing temperature for the carrier core coating layer, when the amount of the silicone oil is less than 2 wt. %, the amount of the silicone oil that oozes from the carrier core coating layer is too small to obtain the above-mentioned advantageous effects of the silicone oil, while when the amount of the silicone oil is more than 10 wt. %, the amount of the silicone oil that oozes from the carrier core coating layer is excessive, so that improper triboelectric charging is apt to take place.

The temperature at which the carrier core coating layer is cured depends upon the content of the silicone oil therein. However, it is preferable that the curing temperature be in the range of about 250° C. to 500° C. For example, when the content of the silicone oil is about 3 wt. %, it is preferable that the curing temperature be about 300° C., while when the content of the silicone oil is about 10 wt. %, it is preferable that the curing temperature be about 400° C. It is considered that by increasing the curing temperature, the bonding of the silicone oil and the silicone resin can be appropriately adjusted, whereby the amount of the silicone oil that oozes from the carrier core coating layer can be controlled. From the above, the inventors of the present invention have discovered that in order to maintain an appropriate amount of the silicone oil in the carrier core coating layer, it is required that the curing temperature be appropriately set so as to maintain the appropriate amount of the silicone oil in the carrier core coating layer.

In the present invention, the fluidity is adjusted to 45 seconds or less per 50 g, preferably in the range of 20 to 45 seconds/50 g, by adjusting the amount of the silicone oil that oozes from the carrier core coating layer by the method as mentioned above. When the fluidity exceeds 45 seconds/50 g, the toner cannot be smoothly charged by the carrier because of the poor fluidity thereof, so that image quality tends to become poor, while when the fluidity is less than 20 seconds/50 g, there is a tendency that the developer cannot be transported smoothly when transported by utilizing the frictional resistance of the developer.

Some carriers coated with the carrier core coating layer comprising the silicone oil and the silicone resin have poor fluidity than the fluidity of a carrier coarse coating layer prepared without using the silicone oil. This indicates that an excessive amount of the silicone oil is present on the surface of the carrier particles of the former carriers. In such carriers, the amount of silicone oil that oozes from the carrier coating layer will have to be controlled by the above-mentioned method of the present invention.

In order to cope with the recent demand for high quality images that can be obtained by image formation apparatus, the particle diameter of the toner particles is being reduced. However, as the particle diameter of the toner particles is reduced, the surface area of the toner particles per unit amount thereof increases and therefore, the blocking of the toner particles in a toner container is apt to take place, so that the developing performance and the image transfer performance are caused to deteriorate, and the image quality that can be obtained tends to become poor.

Conventionally, in order to increase the fluidity of the toner, additives such as silica, titania and alumina are generally used and studies on the increasing of the amount of such additives to be added have been made. When the amount of such an additive added is increased, the fluidity of the toner can be surely improved and the image quality that can be obtained can also be improved. However, such additives tend to abrade the carrier core coating layer, or are apt to be deposited in the form of a film on the surface of the photoconductor, or scratch the surface of the photoconductor.

In the present invention, as mentioned above, the toner transfer performance can be exceedingly improved by use of the silicone oil, so that the amount of the additives for use with the toner can be significantly reduced in comparison with a conventionally employed amount of more than 0.8 wt. %. Thus, according to the present invention, the amount of the additives for use with the toner is not more than 0.8 wt. %, so that there can be avoided the side effects of the additives, such as the environmental variations in the triboelectric charge quantity, the shaving of the carrier core coating layer, and the film-like deposition of the additives on the surface of the photoconductor.

In the present invention, as the core particles, there can be employed particles substantially made of only a magnetic material such as magnetic ferrite, and magnetic-material-dispersed resin core particles composed of a number of finely-divided magnetic particles dispersed in a resin.

As the magnetic material for the magnetic core particles, there can be employed magnetic metals such as iron, nickel and cobalt, alloys thereof, and alloys containing rare earth elements; soft ferrites such as hematite, magnetite, manganese-zinc based ferrites, nickel-zinc based ferrite, manganese-magnesium based ferrite and lithium based ferrite; iron based oxides such as copper-zinc ferrite, and mixtures thereof.

Furthermore, there can be employed other iron based alloys such as iron-silicon based alloy, iron-aluminum based alloy, and permalloy.

In the present invention, it is preferable to employ magnetic ferrite core particles containing at least one element selected from the group of the elements of IA, IIA, IIIA, IVA, VA, VIA, IB, IIB, IIIB, IVB, VB, VIB, VIIB and VIII, with the content of other elements being less than 1 wt. %.

The magnetic core particles for use in the present invention can be produced by a sintering method or an atomizing method, when necessary, with the particle diameter distribution of the magnetic particles being made sharp, or with predetermined magnetic characteristics being imparted theret by controlling, for instance, the sintering temperature, the temperature elevation rate, and the heat application time.

There is no particular limitation to the specific resistance of the magnetic core particles for use in the present invention as long as the magnetic core particles satisfy desired magnetic characteristics. However, it is preferable to use ferrite particles or magnetite particles with a specific resistance in the range of $10^5$ Ω·cm to $10^5$ Ω·cm.

As the magnetic material for the magnetic-material-dispersed resin core particles, which magnetic material is dispersed in a resin, for example, there can be employed alloys and compounds of ferromagnetic metals such as iron, cobalt, and nickel.

It is preferable that the carrier for use in the present invention have a weight-average particle diameter of 35 to 60 μm. When the average particle diameter of the carrier is less than 35 μm, a latent electrostatic image held on a latent electrostatic image bearing member is apt to be developed with the carrier, so that the latent electrostatic image bearing member, a cleaning blade and a charging roller are apt to be scratched by the carrier. On the other hand, when the average particle diameter of the carrier is more than 60 μm, in particular, when used in combination with the small-particle diameter toner, the carrier's toner holding performance, which depends upon the surface area of the carrier particles on which the toner is held, and the carrier's toner charging performance are reduced, so that the density of solid toner image tends to be non-uniform, and the scattering of the toner and the fogging of toner images are apt to take place.

As the material for the carrier core coating layer of the carrier for use in the present invention, silicone resins in general use can be employed. Specific examples of such silicone resins are straight silicone resins such as "SH804", "SH805" and "SR2400", made by Dow Corning Toray Silicone Co., Ltd., and silicone-modified organic resins such as "SR2107" and "SR2115", made by Dow Corning Toray Silicone Co., Ltd. it is considered that such silicone resins have excellent compatibility with the silicone oil, so that appropriate oozing of the silicone oil froms the carrier core coating layer can be attained.

As the silicone oil for the carrier for use in the present invention, a commercially available dimethyl silicone oil, such as "SH20", made by Dow Corning Toray Silicone Co., Ltd., and a modified silicone oil, such as "SF8417" and "SF8421", made by Dow Corning Toray Silicone Co., Ltd., can be employed.

In the present invention, it is preferable that about 1 to 60 parts by weight of the toner be mixed with 100 parts by weight of the carrier to use the mixture as the two-component developer.

It is preferable that the toner for use in the present invention be prepared by kneading a mixture of a binder resin in an amount of 75 to 93 wt. %, a coloring agent in an amount of 3 to 10 wt. %, a releasing agent in an amount of 3 to 8 wt. %, and other components in an amount of 1 to 7 wt. %, and pulverizing the kneaded mixture. It is also preferable that as an additive, finely-divided particles of an inorganic material such as colloidal silica, be externally added to the toner, in an amount of 0.8 wt. % or less in the entire amount of the toner.

Abrasives, for example, metallic oxides such as titanium oxide and aluminum oxide, and silicon carbide; and a lubricant such as a fatty acid metallic salt, may also be added as the additives to the toner.

Conventionally known resins can be used as the binder resins for use in the toner. In particular, as the binder resin, styrene resins such as a styrene homopolymer and copolymers of styrene monomer and other vinyl monomers are employed.

Specific examples of the above-mentioned other vinyl monomer are ethylene unsaturated mono-olefins such as ethylene, propylene and isobutylene; halogenated vinyl monomers such as vinyl chloride, vinyl bromide and vinyl fluoride; vinyl esters such as vinyl acetate; acrylic esters such as methyl acrylate, ethyl acrylate and phenyl acrylate; vinyl ethers such as vinyl methyl ether and vinyl ethyl ether; vinylketones such as vinyl methyl ketone and vinyl hexyl ketone; N-vinyl compounds such as N-vinylpyrrole and N-vinylpyrrolidone; acrylonitrile; methacrylonitrile; acrylamide; and methacrylanide. These vinyl monomers can be employed alone or in combination.

In addition to the above-mentioned styrene resins, polyethylene resin, polypropylene resin, vinyl ester resin, rosin-modified phenol-formalin resin, epoxy resin, polyester resin, and polyol resin, and mixtures of the above-mentioned resins can also be used as the binder resins.

As the coloring agents for the toner for use in electrophotography in the present invention, any conventional coloring agents can be employed.

Examples of yellow coloring agents are C.I. Pigment Yellow 1 (Trademark "Symuler Fast Yellow GH", made by Dainippon Ink and Chemicals, Incorporated); C.I. Pigment Yellow 3 (Trademark "Symuler Fast Yellow 10GH", made by Dainippon Ink and Chemicals, Incorporated); C.I. Pigment Yellow 12 (Trademark "Symuler Fast Yellow GF", made by Dainippon Ink and Chemicals, Incorporated, Trademark "Yellow 152" made by Arimoto Chemical Co., Ltd., Trademark "Pigment Yellow GRT", made by Sanyo Color Works, Ltd., Trademark "Sumikaprint Yellow ST-O", made by Sumitomo Chemical Co., Ltd., Trademark "Benzidine Yellow 1316", made by Noma Chemical Industry Co., Ltd., Trademark "Seika Fast Yellow 2300", made by Dainichiseika Color & Chemicals Mfg. Co., Ltd., and Trademark "Lionol Yellow GRT", made by Toyo ink Mfg. Co., Ltd.); C.I. Pigment Yellow 13 (Trademark "Symuler Fast Yellow 5GR", made by Dainippon Ink and Chemicals, Incorporated); C.I. Pigment Yellow 14 (Trademark "Symuler Fast Yellow 5GR", made by Dainippon Ink and Chemicals, Incorporated); and C.I. Pigment Yellow 17 (Trademark "Symuler Fast Yellow 8GR", made by Dainippon Ink and Chemicals, Incorporated, and Trademark "Lionol Yellow FGNT", made by Toyo Ink Mfg. Co., Ltd.).

Examples of magenta coloring agents are C.I. Pigment Red 5 (Trademark "Symuler East Carmine FB", made by Dainippon ink and Chemicals, Incorporated); C.I. Pigment Red 18 (Trademnark "Sanyo Toluidine Maroon Medium", made by Sanyo Color Works, Ltd.); C.I. Pigment Red 21 (Trademark "Sanyo Fast Red GR", made by Sanyo Color Works, Ltd.); C.I. Pigment Red 22 (Trademark "Symular Fast Brill Scarlet BG", made by Dainippon Ink and Chemicals, Incorporated); C.I. Pigment Red 57 (Trademark "Symuler Brill Carmine LB", made by Dainippon Ink and Chemicals, Incorporated); C.I. Pigment Red 81 (Trademark "Symulex Rhodamine Y Toner F", made by Dainippon Ink and Chemicals, Incorporated); C.I. Pigment Red 112 (Trademark "Symuler Fast Red FGR", made by Dainippon Ink and Chemicals, Incorporated); C.I. Pigment Red 114 (Trademark "Symuler Fast Carmine BS", made by Dainippon Ink and Chemicals, Incorcorated); and C.I. Pigment Red 122 (Trademark "Fastogen Super Magenta RE 02", made by Dainippon Ink and Chemicals, Incorporated).

Examples of cyan coloring agents are C.I. Pigment Blue 15 (Trademark "Fastogen Blue GS", made by Dainippon Ink and Chemicals, Incorporated, and Trademark "Chromofine SR", made by Dainichiseika Color & Chemicals Mfg. Co., Ltd.); C.I. Pigment Blue 16 (Trademark "Sunmitone Cyanine Blue LG", made by Sumitomo Chemical Co., Ltd.); C.I. Pigment Blue 15:3 (Trademark "Cyanine Blue GGK", made by Nippon Pigment Co., Ltd., and Trademark "Lionol Blue FG 7351", made by Toyo Ink Mfg. Co., Ltd.); C.I. Pigment Green 7 (Trademark "Phthalogcyanine Green", made by Tokyo Printing Ink Mfg. Co., Ltd.); and C.I. Pigment Green 36 (Trademark "Cyanine Green ZYL", made by Toyo Ink Mfg. Co., Ltd.).

Examples of black coloring agents are carbon black, spirit black and Aniline Black (C.I. Pigment Black 1).

The toner for use in the present invention may further comprise a charge controlling agent. Various kinds of conventional charge controlling agents can be used, and specific examples thereof are a metal-containing monoazo dye, nitrohumic acid and salts thereof, salicylic acid, naphthoic acid, dicarboxylic acid complexes of metals such as Co, Cr and Fe, amino compounds, quaternary ammonium compounds, and organic dyes.

The characteristics of the developer of the present invention were mneasured as follows:

(1) Measurement of the Particle Diameter Distribution of the Toner:

The particle diameter distribution of the toner of the present invention was measured by use of Coulter counter, although there are various kinds of methods for measuring the particle diameter distribution.

(2) Measurement of the Fluidity of the Carrier:

For the measurement of the fluidity of the carrier, each test sample was allowed to stand at a temperature of 23° C.±3° C., and a humidity of 60%±5% for 24 hours, and then the fluidity of the sample was measured in accordance with the Japanese Industrial Standards (JIS-Z 2502).

Other Features of this invention will become apparent in the course of the following description of exemplary embodiments, which are given for illustration of the invention and are not intended to be limiting thereof.

EXAMPLE 1

Preparation of Toner A

A mixture of the following components was subjected to a preliminary mixing by sufficiently mixing the mixture in a Henschel mixer:

| | Parts by weight |
|---|---|
| Unsaturated polyester resin | 100 |
| Carbon black pigment | 5 |
| Charge controlling agent (salicylic acid chrome complex) | 4.0 |

The above mixture was fused and kneaded in a double-screw extruder, and cooled. The cooled mixture was then roughly hammer milled to obtain particles with a diameter of about 1 to 2 mm, and then finely pulverized in an air-jet type mill The thus finely pulverized particles were then classified, using a multi-divided classifier, whereby classified toner particles with a particle diameter of 6.5 μm (carbon-containing resin particles) were obtained. To 100 parts by weight of the thus obtained classified toner particles, 0.75 parts by weight of a commercially available hydrophobic silica (Trademark "R976" made by Nippon Aerosil Co., Ltd.) were added, and the mixture was mixed in a mixer, whereby Toner A was prepared.

Preparation of Toner A

The above-mentioned procedure for preparing Toner A was repeated except that the amount of the hydrophobic silica "R976" was changed from 0.75 parts by weight to 1.5 parts by weight, whereby Toner B was prepared.

Preparation of Toner C

The above-mentioned procedure for preparing Toner A was repeated except that instead of the classified toner particles with a particle diameter of 6.5 μm prepared in the procedure of the preparation of Toner A, classified toner particles with a particle diameter of 9.0 μm were obtained by changing the fine pulverizing conditions and the classification conditions in the procedure of the preparation of Toner A, and to 100 parts by weight of the thus obtained classified toner particles, 0.75 parts by weight of a commercially available hydrophobic silica (Trademark "R976" made by Nippon Aerosil Co., Ltd.) were added, and the mixture was mixed in a mixer, whereby Toner C was prepared.

Preparation of Toner D

The above-mentioned procedure for preparing Toner C was repeated except that the amount of the hydrophobic Silica "R976" was changed from 0.75 parts by weight to 1.5 parts by weight, whereby Toner D was prepared.

Preparation of Carrier(a)

Cu—Zn—Fe based ferrite core particles with a particle diameter of 50 μm were subjected to 10% coating, using a commercially available silicone resin (Trademark "SR2411", made by Dow Corning Toray Silicone Co., Ltd., in the form of a solution of silicone resin in toluene, with a solid component content of 20%). The 10% coating was conducted in such a manner that 100 parts by weight of the core particles were coated with 10 parts by weight of the solid component contained in the silicone resin in the form of the toluene solution when dried.

The Cu—Zn—Fe based ferrite core particles coated with the silicone resin were heated to 300° C. for 2 hours, whereby Carrier (a) with a carrier core coating layer of 0.5 μm was prepared.

Preparation of Carrier(b)

Cu—Zn—Fe based ferrite core particles with a particle diameter of 50 μm were subjected to 10% coating, using a mixture of the following components:

| | Parts by weight |
|---|---|
| Silicone resin (Trademark "SR2411", made by Dow Corning Toray Silicone Co., Ltd., in the form of a solution of silicone resin in toluene, with a solid component content of 20%) | 500 |
| Silicone oil (Trademark "SH200", made by Dow Corning Toray Silicone Co., Ltd., 3000 cs) | 10 |

The 10% coating was conducted in such a manner that 100 parts by weight of the core particles were coated with 10 parts by weight of a mixture of the solid component contained in the silicone resin in the form of the toluene solution and the silicone oil in the above-mentioned mixture when dried.

The Cu—Zn—Fe based ferrite care particles coated with the above-mentioned mixture of the solid component of the silicone resin and the silicone oil were heated to 200° C. for 2 hours, whereby Carrier (b) with a carrier core coating layer of 0.5 μm was prepared.

Preparation of Carrier(c)

Cu—Zn—Fe based ferrite core particles with a particle diameter of 50 μm were subjected to 10% coating, using a mixture of the following components:

| | Parts by weight |
|---|---|
| Silicone oil (Trademark "SH200", made by Dow Corning Toray Silicone Co., Ltd., 3000 cs) | 20 |
| Toluene | 80 |

The 10% coating was conducted in such a manner that 100 parts by weight of the core particles were coated with 10 parts by weight of the silicone oil in the above-mentioned mixture when dried.

The Cu—Zn—Fe based ferrite core particles coated with tne silicone oil were heated to 400° C. for 2 hours, whereby Carrier (c) was prepared.

Preparation of Carrier(d)

Cu—Zn—Fe based ferrite core particles with a particle diameter of 50 μm were subjected to 10% coating, using a mixture of the following components:

| | Parts by weight |
|---|---|
| Silicone resin (Trademark "SR2411", made by Dow Corning Toray Silicone Co., Ltd., in the form of a solution of silicone resin in toluene, | 500 |

-continued

| | Parts by weight |
|---|---|
| with a solid component content of 20%) | |
| Silicone oil (Trademark "SH200", made by Dow Corning Toray Silicone Co., Ltd., 3000 cs) | 3 |

The 10% coating was conducted in such a manner that 100 parts by weight of the core particles were coated with 10 parts by weight of a mixture of the solid component contained in the silicone resin in the form of the toluene solution and the silicone oil in the above-mentioned mixture when dried.

The Cu—Zn—Fe based ferrite core particles coated with the above-mentioned mixture of the solid component of the silicone resin and the silicone oil were heated to 300° C. for 2 hours, whereby Carrier (d) with a carrier core coating layer of 0.5 μm was prepared.

Preparation of Carrier(e)

Cu—Zn—Fe based ferrite core particles with a particle diameter of 50 μm were subjected to 10% coating, using a mixture of the following components:

| | Parts by weight |
|---|---|
| Silicone resin (Trademark "SR2411", made by Dow Corning Toray Silicone Co., Ltd., in the form of a solution of silicone resin in toluene, with a solid component content of 20%) | 500 |
| Silicone oil (Trademark "SH200", made by Dow Corning Toray Silicone Co., Ltd., 3000 cs) | 6 |

The 10% coating was conducted in such a manner that 100 parts by weight of the core particles were coated with 10 parts by weight of a mixture of the solid component contained in the silicone resin in the form of the toluene solution and the silicone oil in the above-mentioned mixture when dried.

The Cu—Zn—Fe based ferrite core particles coated with the above-mentioned mixture of the solid component of the silicone resin and the silicone oil were heated to 350° C. for 2 hours, whereby Carrier (e) with a carrier core coating layer of 0.5 μm was prepared.

Preparation of Carrier(f)

Cu—Zn—Fe based ferrite core particles with a particle diameter of 50 μm were subjected to 10% coating, using a mixture of the following components:

| | Parts by weight |
|---|---|
| Silicone resin (Trademark "SR2411", made by Dow Corning Toray Silicone Co., Ltd., in the form of a solution of silicone resin in toluene, | 500 |

-continued

| | Parts by weight |
|---|---|
| with a solid component content of 20%) | |
| Silicone oil (Trademark "SH200", made by Dow Corning Toray Silicone Co., Ltd., 3000 cs) | 12 |

The 10% coating was conducted in such a manner that 100 parts by weight of the core particles were coated with 10 parts by weight of a mixture of the solid component contained in the silicone resin in the form of the toluene solution and the silicone oil in the above-mentioned mixture when dried.

The Cu—Zn—Fe based ferrite core particles coated with the above-mentioned mixture of the solid component of the silicone resin and the silicone oil were heated to 400° C. for 2 hours, whereby Carrier (f) with a carrier core coating layer of 0.5 μm was prepared.

Preparation of Carrier(g)

Cu—Zn—Fe based ferrite core particles with a particle diameter of 65 μm were subjected to 10% coating, using a mixture of the following components:

| | Parts by weight |
|---|---|
| Silicone resin (Trademark "SR2411" made by Dow Corning Toray Silicone Co., Ltd., in the form of a solution of silicone resin in toluene, with a solid component content of 20%) | 500 |
| Silicone oil (Trademark "SH200", made by Dow Corning Toray Silicone Co., Ltd., 3000 cs) | 3 |

The 10% coating was conducted in such a manner that 100 parts by weight of the core particles were coated with 10 parts by weight of a mixture of the solid component contained in the silicone resin in the form of the toluene solution and the silicone oil in the above-mentioned mixture when dried.

The Cu—Zn—Fe based ferrite core particles coated with the above-mentioned mixture of the solid component of the silicone resin and the silicone oil were heated to 300° C. for 2 hours, whereby Carrier (g) with a carrier core coating layer of 0.65 μm was prepared.

Preparation of Two-component Developers

By using Toners A to D, and Carriers (a) to (g) in such combnations as listed in TABLE 1, two-component developers were prepared, with 5 parts by weight of each toner and 95 parts by weight of each carrier being mixed in each of the two-component developers.

Evaluation of Two-component Developers

Each of the two-component developers was incorporated in a modified commercially available copying machine (Trademark "MF-200" made by Ricoh Company, Ltd.) and 200,000 copies at the maximum were made to test the durability of each of the two-component developers. The results are shown in TABLE 1.

TABLE 1

| | | Ex. 1 | Ex. 2 | Ex. 3 | Comp. Ex. 1 | Comp. Ex. 2 | Comp. Ex. 3 | Comp. Ex. 4 | Comp. Ex. 5 | Comp. Ex. 6 | Comp. Ex. 7 |
|---|---|---|---|---|---|---|---|---|---|---|---|
| Carrier | | (d) | (e) | (g) | (a) | (a) | (b) | (c) | (d) | (d) | (f) |
| Fluidity | sec/50 g | 36.8 | 39.4 | 33.3 | 36.9 | 36.9 | No flow | No flow | 36.8 | 36.8 | 47.7 |
| Toner | | A | A | A | A | B | A | A | C | D | A |
| Life of Developer | Number of copies made | 200 K or more | 150 K | 150 K | 100 K | 50 K | 10 K | 10 K | 200 K or more | 120 K | 75 K |
| Reproduction of Thin Line Images | Rank | 5 | 5 | 4 | 2 | 4 | 3 | 3 | 2 | 3 | 3 |
| Life of OPC | Number of copies made | 200 K or more | 200 K or more | 200 K or more | 75 K | 40 K | 200 K or more | 200 K or more | 200 K or more | 100 K | 200 K or more |

In TABLE 1, "No flow" denotes that the carrier did not indicate any fluidity, and "K" denotes 1,000, so that, for instance, 200 K indicates 200,000.

In TABLE 1, the life of each developer, the reproduction of thin line images, and the life of the OPC were evaluated as follows;

Life of Developer:

Maximum number of copies made at which the background deposition of the toner became too much to be used in practice.

Reproduction of Thin Line Images:

One dot line image was formed and the image quality thereof was evaluated, using 5 ranks, with respect to the blurring of the image, and the formation of a thinner or thicker line image than the original line image with reference to a limit sample. Rank 5 is the best, and Rank 1 (not shown) is the worst, and Ranks 2 to 4 are successively better between Rank 1 and Rank 5.

Life of the OPC:

Evaluated by the maximum number of copes made at which the surface of the OPC began to be scratched.

The results shown in TABLE 1 indicates that two-component developer of the present invention is capable of reproducing copied images with high quality, high precision and high reliability by electrophotography over an extended period of time.

Japanese Patent Application No. 10-183281 is hereby incorporated by reference.

What is claimed is:

1. A two-component developer comprising;

a toner comprising toner particles with a volume diameter of 8 $\mu$m or less, and a carrier comprising carrier particles, each carrier particle comprising at least one core particle and a carrier core coating layer, said carrier core coating layer comprising a silicone resin and a silicone oil, said carrier having a fluidity of 45 seconds or less.

2. The two-component developer as claimed in claim 1, wherein said carrier particles have a weight-average particle diameter of 60 $\mu$m or less.

* * * * *

UNITED STATES PATENT AND TRADEMARK OFFICE

CERTIFICATE OF CORRECTION

PATENT NO. : 6,228,550 B1
DATED : May 8, 2001
INVENTOR(S) : Hiroaki Matsuda et al.

It is certified that error appears in the above-identified patent and that said Letters Patent is hereby corrected as shown below:

Column 5,
Line 34, "the range of $10^5$ Ω·cm to $10^5$ Ω·cm" should read -- the range of $10^5$ Ω·cm to $10^{10}$ Ω·cm --;
Line 64, "Ltd. it is" should read -- Ltd. It is --;
Line 66, "oil froms the" should read -- oil from the --.

Column 6,
Line 67, "5GR"," should read -- GRF", --.

Column 7,
Line 9, "Dainippon ink" should read -- Dainippon Ink --;
Line 30, "(Trademark "Sunmitone" should read -- (Trademark "Sumitone --.

Column 8,
Line 29, "Toner A" should read -- Toner B --;
Line 50, "Silica" should read -- silica --.

Column 12,
Line 61, "copes made" should read -- copies made --.

Signed and Sealed this

Fifth Day of March, 2002

*Attest:*

*Attesting Officer*

JAMES E. ROGAN
*Director of the United States Patent and Trademark Office*